US009525272B2

(12) United States Patent
Bohne et al.

(10) Patent No.: US 9,525,272 B2
(45) Date of Patent: Dec. 20, 2016

(54) CORONA IGNITION DEVICE

(71) Applicant: BorgWarner Ludwigsburg GmbH, Ludwigsburg (DE)

(72) Inventors: Steffen Bohne, Ludwigsburg (DE); Timo Stifel, Stuttgart (DE); Johann Weissenbacher, Obersulm-Sülzbach (DE)

(73) Assignee: BorgWarner Ludwigsburg GmbH (DE)

( * ) Notice: Subject to any disclaimer, the term of this patent is extended or adjusted under 35 U.S.C. 154(b) by 75 days.

(21) Appl. No.: 14/512,526

(22) Filed: Oct. 13, 2014

(65) Prior Publication Data

US 2015/0116888 A1 Apr. 30, 2015

(30) Foreign Application Priority Data

Oct. 24, 2013 (DE) ..... 10 2013 111 725
May 27, 2014 (DE) ..... 10 2014 107 486

(51) Int. Cl.
*H01T 23/00* (2006.01)
*H01T 13/50* (2006.01)
*H01T 13/20* (2006.01)

(52) U.S. Cl.
CPC ..... *H01T 13/50* (2013.01); *H01T 13/20* (2013.01)

(58) Field of Classification Search
CPC ..... H01T 19/00
USPC ..... 361/230
See application file for complete search history.

(56) References Cited

U.S. PATENT DOCUMENTS

| | | | | |
|---|---|---|---|---|
| 2009/0033194 | A1 | 2/2009 | Jaffrezic et al. | |
| 2010/0175655 | A1 | 7/2010 | Lykowski et al. | |
| 2011/0163654 | A1 | 7/2011 | Malek et al. | |
| 2011/0297116 | A1 | 12/2011 | Ruan et al. | |
| 2013/0003251 | A1 | 1/2013 | Durham et al. | |
| 2013/0199484 | A1 | 8/2013 | Stifel et al. | |
| 2013/0340697 | A1* | 12/2013 | Burrows | H01T 13/50 123/146.5 R |
| 2014/0116370 | A1* | 5/2014 | Stifel | F02P 23/04 123/143 B |

FOREIGN PATENT DOCUMENTS

| | | | |
|---|---|---|---|
| DE | 197 47 700 | A1 | 5/1999 |
| DE | 10 2010 045 171 | A1 | 12/2011 |
| DE | 10 2012 108 251 | A1 | 4/2013 |
| EP | 1 875 571 | B1 | 8/2010 |
| EP | 1 869 739 | B1 | 9/2011 |

* cited by examiner

*Primary Examiner* — Dharti Patel
(74) *Attorney, Agent, or Firm* — Bose McKinney & Evans LLP

(57) ABSTRACT

Described is a corona ignition device comprising an insulator, a housing that is closed at its front end by the insulator, a center electrode that protrudes out of a front end of the insulator and has at least one ignition tip, wherein the insulator protrudes out of the housing and widens outside of the housing. The insulator curves in a dome-shaped manner over the front end of the housing.

18 Claims, 2 Drawing Sheets

CORONA IGNITION DEVICE

RELATED APPLICATIONS

This application claims priority to DE 10 2013 111 725.2, filed Oct. 24, 2013, and DE 10 2014 107 486.6, filed May 27, 2014, both of which are hereby incorporated herein by reference in their entireties.

BACKGROUND

The invention relates to a corona ignition device of the type generally known from DE 10 2012 108 251 A1.

The insulator of such a corona ignition device protrudes with an end portion out of the housing of the corona ignition device. For the shape of the insulator, in particular the end portion thereof, a multiplicity of variants is known. Thus, for example, EP 1 869 739 B1 discloses a corona ignition device, the isolator of which has a cylindrical end portion; US 2010/0175655 A1 discloses a corona ignition device, the insulator of which has an end portion in the form of a truncated cone having an acute cone angle; EP 1 875 571 B1 discloses a corona ignition device, the insulator of which has an end portion in the form of a truncated cone having an obtuse cone angle, and US 2013/0003251 A1 discloses a corona ignition device, the insulator of which has a conical recess in which a plurality of ignition tips of the center electrode are arranged.

The influence of the insulator on the function and the service life of a corona ignition device is complex. Deposits of fuel residues as well as cracks, which can occur during the operation due to thermal stress or temperature shocks, can negatively affect the function of a corona ignition device. Moreover, the insulator, due to its thermal coupling to the center electrode inserted therein, also influences the temperature of ignition tips of the center electrode and thus indirectly also influences the ignition behaviour of the ignition tips and the wear thereon.

SUMMARY

This disclosure teaches how function and service life of a corona ignition device can be improved.

In a corona ignition device according to this disclosure, the insulator is inserted in the housing and protrudes with an end portion out of the housing's front end on the combustion chamber side. This end portion is curved in a dome-shaped manner over the housing and covers completely or partially the front end of the housing. At the front end of the housing, the end portion of the insulator thus has a greater width than the insulator in the housing.

This shape of the insulator results, on the one hand, in a sufficiently high surface temperature in order to largely avoid deposits of fuel residues and, on the other, it enables uniform heat absorption and heat dissipation so that local temperature peaks on the insulator surface can be avoided. This is an important advantage because local temperature peaks result in thermal stress and thus promote crack formation and can cause undesirable glow ignitions of fuel.

Since outside of the housing, the insulator initially widens and thus covers the front end of the housing, good electrical shielding is also achieved and undesirable formation of arc discharges between the center electrode and the housing of the corona ignition device is therefore made difficult.

By a dome-shaped curvature, edges and tight radii of curvature on the outer surface of the insulator are avoided, which is of advantage for a uniform surface temperature of the isolator and also for the electrical properties of the corona ignition device. The dome-shaped curvature has an apex at which the center electrode protrudes out of the insulator and a root circle from which the dome-shaped curvature extends.

In an advantageous refinement of this disclosure, each longitudinal portion of the dome-shaped curvature of the insulator that runs through the apex of the curvature has everywhere a radius of curvature that is at least a third of the radius of the root circle of the curvature. For example, each longitudinal portion of the dome-shaped curvature of the insulator that runs through the apex of the curvature can everywhere have a radius of curvature that is at least half of the radius of the root circle of the curvature or even two third of the radius of the root circle of the curvature, or more.

A further advantageous refinement of this disclosure provides that the dome-shaped curvature of the insulator is prolate. Thus, the height of the dome-shaped curvature measured from the plane of the root circle up to the apex is greater than the radius of the root circle. This enables an increased surface temperature of the isolator, which counteracts the deposition of combustion residues. For example, the height of the curvature can be 60% or more of the diameter of the root circle, in particular 70% or more. The height of the curvature preferably corresponds to the length over which the insulator protrudes out of the housing. The diameter of the root circle is also preferably the maximum diameter of the insulator.

A height of the dome-shaped curvature that is greater than the diameter of the root circle is possible; however, this has no advantages. The height of the curvature is therefore preferably less than the diameter of the root circle, for example, is not greater than 90% of the diameter of the root circle, or is even only 70% or less of the diameter of the root circle.

Another advantageous refinement of this disclosure provides that the housing has at its front end a diameter that corresponds to the maximum diameter of the insulator. The insulator thus can be flush with the housing and effects very good shielding between the center electrode and the housing.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
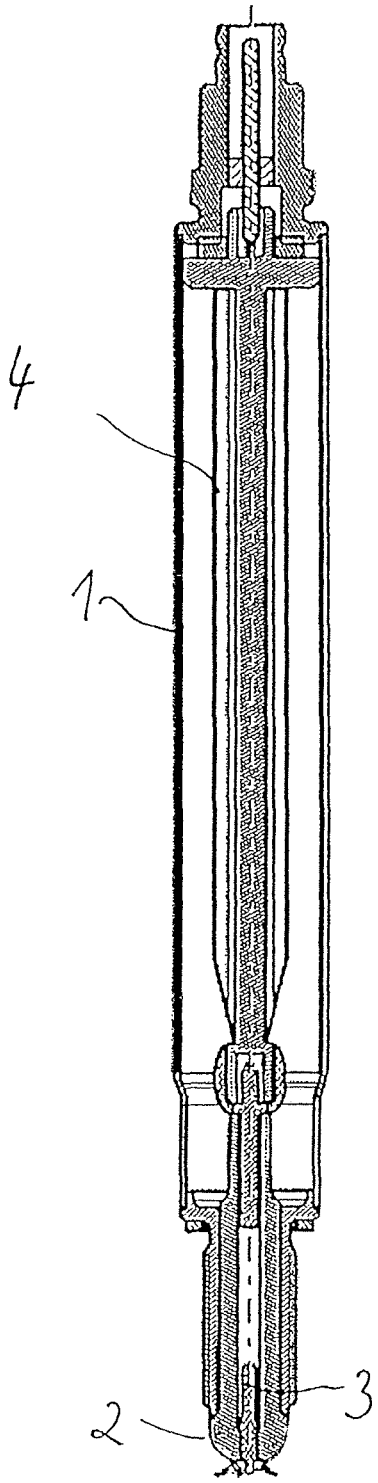
FIG. 1 shows a schematic longitudinal sectional view of a corona ignition device.

The corona ignition device schematically illustrated in a longitudinal portion in FIG. 1 generates a corona discharge for igniting fuel in a combustion chamber of an engine. The corona ignition device has a housing 1 that is closed at a front end by an isolator 2. A center electrode 3 which has one or more ignition tips protrudes out of the front end of the insulator 2. The center electrode 3 together with the insulator 2 and the housing 1 form a capacitance that is connected in series with a coil 4 connected to the center electrode 3. This capacitance and the coil 4 are part of an electric resonant circuit. By exciting this resonant circuit corona discharges can be generated at the ignition tips or the ignition tip of the center electrode 3.

Figure 2:
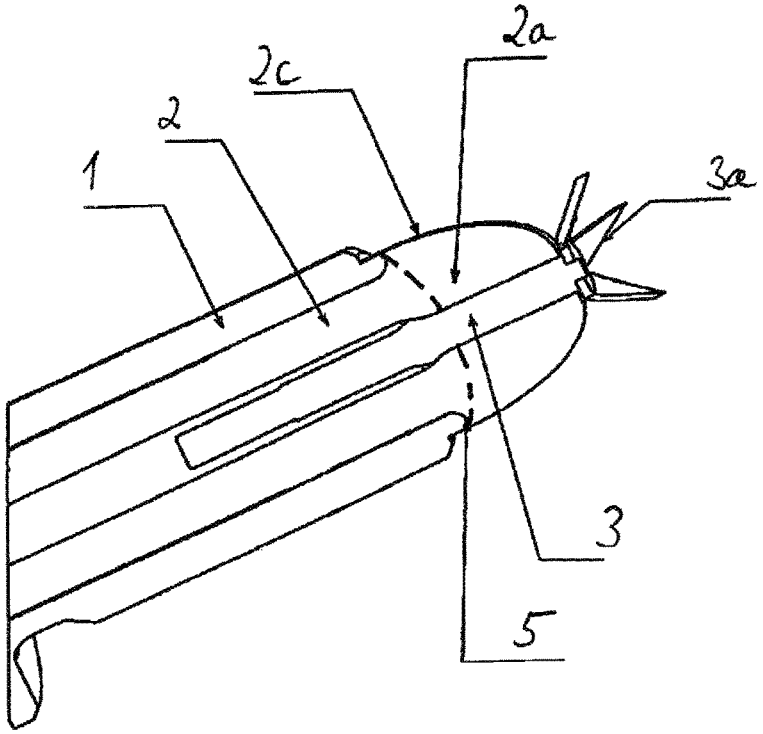
FIG. 2 shows a detailed view of FIG. 1.

FIG. 2 illustrates the front end of the corona ignition device in a longitudinal sectional view. An end portion 2*a* of the insulator 2 protrudes out of the front end of the housing 1. This end portion 2*a* is curved in a dome-shaped manner over the housing 1. The insulator 2 thus widens outside of the housing 1 and covers the front end of the housing 1, namely the front face thereof. The maximum width of the insulator 2 thus corresponds to the width of the housing 1 at the front housing end.

The dome-shaped curvature of the insulator 2 has an apex at which the center electrode 3 protrudes out of the insulator 2. The dome-shaped curvature extends from a base or root circle 5 which, for clarification, is drawn in FIG. 2 as a dashed line. At the root circle, the dome-shaped curvature has its maximum diameter and the insulator 2 thus has its maximum width.

The longitudinal section shown in FIG. 2 runs through the apex of the dome-shaped curvature of the insulator 2. The contour 2*c* of the curvature of such a longitudinal section has a radius of curvature that continuously changes between the apex of the curvature and the root circle of the curvature. At the apex, the radius of curvature is at a minimum and increases in a strictly monotonic manner towards the root circle. The radius of curvature of the contour 2*c* is everywhere at least half as large as the radius of the root circle of the dome-shaped curvature. For example, between the root circle and the apex, the radius of curvature of the contour 2*c* can everywhere be at least 60% of the radius of the root circle, in particular at least two thirds or more. The insulator 2 can be rotationally symmetric to its longitudinal axis.

In the embodiment shown, the curvature changes continuously. However, it is also possible that the dome-shaped curvature is composed of ruled surfaces. In this case, the radius of curvature no longer increases in a strictly monotonic manner up to the root circle.

The contour 2*c* of the longitudinal portion of the dome-shaped curvature of the insulator 2 can be elliptical or parabolic, for example.

The height of the dome-shaped curvature, measured from the root circle to the apex of the insulator 2, corresponds to the length over which the insulator 2 protrudes out of the housing 1. In the exemplary embodiment illustrated, the insulator 2 protrudes out of the housing 1 over a length that is more than half of the maximum width of the insulator 2, thus is greater than the radius of the root circle. For example, the height of the curvature can be 60% or more of the maximum width of the insulator 2. Particularly advantageous, the height of the curvature in the exemplary embodiment shown is 70% or more of the maximum width of the insulator 2. The height of the curvature in the exemplary embodiment shown is less than the diameter of the root circle and is, for example, 90% or less of the maximum width of the insulator 2. Particularly advantageous, the height of the curvature is 80% or less of the maximum width of the insulator 2.

The housing 1 has an end portion, the outer surface of which is flush with dome-shaped curvature of the insulator 2. At its root circle, the curvature can tangentially connect to the outer surface of this end portion. This front end portion of the housing 1 can be shaped cylindrically or can slightly taper on its outer side. At the front end of the housing 1, the outer diameter of the housing corresponds to the outer diameter of the insulator 2, thus to the diameter of the root circle.

In the embodiment illustrated, the center electrode 3 has a plurality of ignition tips 3*a*. Basically, a single ignition tip is sufficient. A center electrode 3 that protrudes with a plurality of ignition tips 3*a* out of the insulator 2 has the advantage of generating a corona discharge in a larger volume.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A corona ignition device, comprising:

an insulator;

a housing that is closed at a front end by the insulator;

a center electrode that protrudes out of a front end of the insulator and has at least one ignition tip;

wherein the insulator protrudes out of the housing and widens outside of the housing;

wherein the insulator curves in a dome-shaped manner over the front end of the housing; and wherein a longitudinal section of the dome-shaped curvature of the insulator has a radius of curvature that changes between an apex of the curvature and a root circle of the curvature, wherein the radius of curvature is everywhere at least a third of the radius of the root circle of the dome-shaped curvature.

2. The corona ignition device according to claim 1, wherein the radius of curvature is everywhere at least half as large as the radius of the root circle of the dome-shaped curvature.

3. The corona ignition device according to claim 1, wherein the radius of curvature increases monotonically from the apex of the curvature up to the root circle of the curvature.

4. The corona ignition device according to claim 1, wherein the radius of curvature increases strictly monotonically from the apex of the curvature up to the root circle of the curvature.

5. The corona ignition device according to claim 1, wherein at the apex of the curvature, the center electrode protrudes out of the insulator.

6. The corona ignition device according to claim 1, wherein the insulator protrudes out of the housing over a length that is more than half of the maximum width of the insulator.

7. The corona ignition device according to claim 1, wherein the insulator protrudes out of the housing over a length that is between 60% and 90% of the maximum width of the insulator.

8. The corona ignition device according to claim 1, wherein the insulator protrudes out of the housing over a length that is between 70% and 80% of the maximum width of the insulator.

9. The corona ignition device according to claim 1, wherein the longitudinal section of the dome-shaped curvature of the insulator has an elliptic or parabolic profile.

10. The corona ignition device according to claim 1, wherein at its front end, the housing has a diameter that corresponds to the maximum diameter of the insulator.

11. The corona ignition device according to claim 1, wherein the housing has an end portion, the outer surface of which is flush with the curvature of the insulator, wherein the curvature connects at its root circle tangentially to the outer surface of the end portion of the housing.

12. The corona ignition device according to claim 1, wherein a coil is arranged in the housing, which coil is electrically connected to the center electrode.

13. A corona ignition device, comprising:

a housing having a front end;

an insulator having a first portion inserted into and closing the front end of the housing and a dome-shaped portion extending from the front end of the housing, the dome-shaped portion being wider than the first portion, wherein the dome-shaped portion completely or partially covers the front end of the housing;

a center electrode that protrudes from the dome-shaped portion of the insulator and has at least one ignition tip; and wherein a longitudinal section of the dome-shaped portion has a radius of curvature that changes between an apex of the curvature and a root circle of the curvature, and wherein the radius of curvature increases monotonically from the apex of the curvature up to the root circle of the curvature.

14. The corona ignition device according to claim 13, wherein the radius of curvature is everywhere at least a third of the radius of the root circle of the dome-shaped curvature.

15. The corona ignition device according to claim 14, wherein at the apex of the curvature, the center electrode protrudes out of the insulator.

16. The corona ignition device according to claim 13, wherein a longitudinal section of the dome-shaped portion has an elliptic or parabolic profile.

17. The corona ignition device according to claim 13, wherein the front end of the housing is flush with the dome-shaped portion of the insulator.

18. The corona ignition device according to claim 13, wherein a coil is arranged in the housing and is electrically connected to the center electrode.

* * * * *